United States Patent [19]

Okabe et al.

[11] 4,264,218

[45] Apr. 28, 1981

[54] PRINTING DEVICE

[75] Inventors: Katsuhiko Okabe, Tokorozawa; Toshiaki Kohayakawa, Tokyo, both of Japan

[73] Assignee: Copal Company Limited, Tokyo, Japan

[21] Appl. No.: 78,586

[22] Filed: Sep. 21, 1979

[30] Foreign Application Priority Data

Sep. 27, 1978 [JP] Japan ..... 53/117974

[51] Int. Cl.[3] ..... B41J 3/44

[52] U.S. Cl. ..... 400/78; 400/605

[58] Field of Search ..... 400/78, 77, 79, 82, 400/582, 583, 584, 585, 585.1, 586, 595, 605

[56] References Cited

U.S. PATENT DOCUMENTS

| | | | |
|---|---|---|---|
| 3,294,956 | 12/1966 | Jenkins et al. | 400/78 X |
| 3,653,483 | 4/1972 | Cortona et al. | 400/585 |
| 3,677,385 | 7/1972 | Bretti et al. | 400/78 X |
| 3,688,691 | 9/1972 | De Vol et al. | 400/82 X |
| 3,825,681 | 7/1974 | Ledarberg et al. | 400/78 X |
| 3,872,959 | 3/1975 | Wang et al. | 400/78 |
| 3,902,418 | 9/1975 | Morishita et al. | 400/586 X |
| 4,011,811 | 3/1977 | Kodis | 400/584 X |
| 4,145,146 | 3/1979 | Ohkawara et al. | 400/605 X |
| 4,167,345 | 9/1979 | Englund et al. | 400/82 X |
| 4,188,138 | 2/1980 | Yamazaki | 400/586 |

FOREIGN PATENT DOCUMENTS

| | | | |
|---|---|---|---|
| 2717126 | 11/1978 | Fed. Rep. of Germany | 400/605 |
| 2812482 | 9/1979 | Fed. Rep. of Germany | 400/605 |
| 557067 | 12/1974 | Switzerland | 400/584 |

OTHER PUBLICATIONS

"Sheet Feeding & Control Device", IBM Tech. Discl. Bulletin, vol. 7, No. 3, Aug. 1964, pp. 254–255.

*Primary Examiner*—E. H. Eickholt

*Attorney, Agent, or Firm*—Cushman, Darby & Cushman

[57] ABSTRACT

This printing device is provided with a printing wheel for printing digits on such printed sheet as a check and another printing means for printing digits on a journal paper. According to this printing device, a series of digits memorized in advance within a printing instructing means by the key operation are simultaneously printed on the printed sheet and journal paper by the operation of a function key. The printing operation, printed sheet feeding operation, journal printing wheel figure feeding operation and returning operation to the original position and journal paper feeding operation are made independently of each other by driving forces transmitted respectively through a plurality of clutch mechanisms.

9 Claims, 5 Drawing Figures

PRINTING DEVICE

BACKGROUND OF THE INVENTION (a) Field of the Invention

This invention relates to printing devices and more particularly to an electric check writer which has a printing section for printing digits on such sheet to be printed as a check and another printing section for printing digits on a journal paper.

(b) Description of the Prior Art

Heretofore, a check writer and a journal printing device have been respectively separately sold and used. If these two printing devices are to be used in association with each other, for example, in the accounting business, they will be a considerable burden on the operator. If there is a printing device provided with these two functions, the efficiency of such work as arranging slips in the business department will be remarkably improved.

SUMMARY OF THE INVENTION

In view of the above mentioned circumstances, a primary object of the present invention is to provide a printing device of a new type wherein a first printing means having a function as of a check writer and a second printing means as a journal printing means are provided and are operated simultaneously or separately.

Another object of the present invention is to provide a printing device wherein the above mentioned first and second printing means are formed to be very compact as a whole and a series of operations can be made smoothly and positively.

A further object of the present invention is to provide a printing device of the above mentioned new type wherein the association with the printing instructing means can be simplified.

These and other objects of the present invention will become more apparent during the course of the following detailed description and appended claims.

DESCRIPTION OF THE PREFERRED EMBODIMENT

Figure 1:
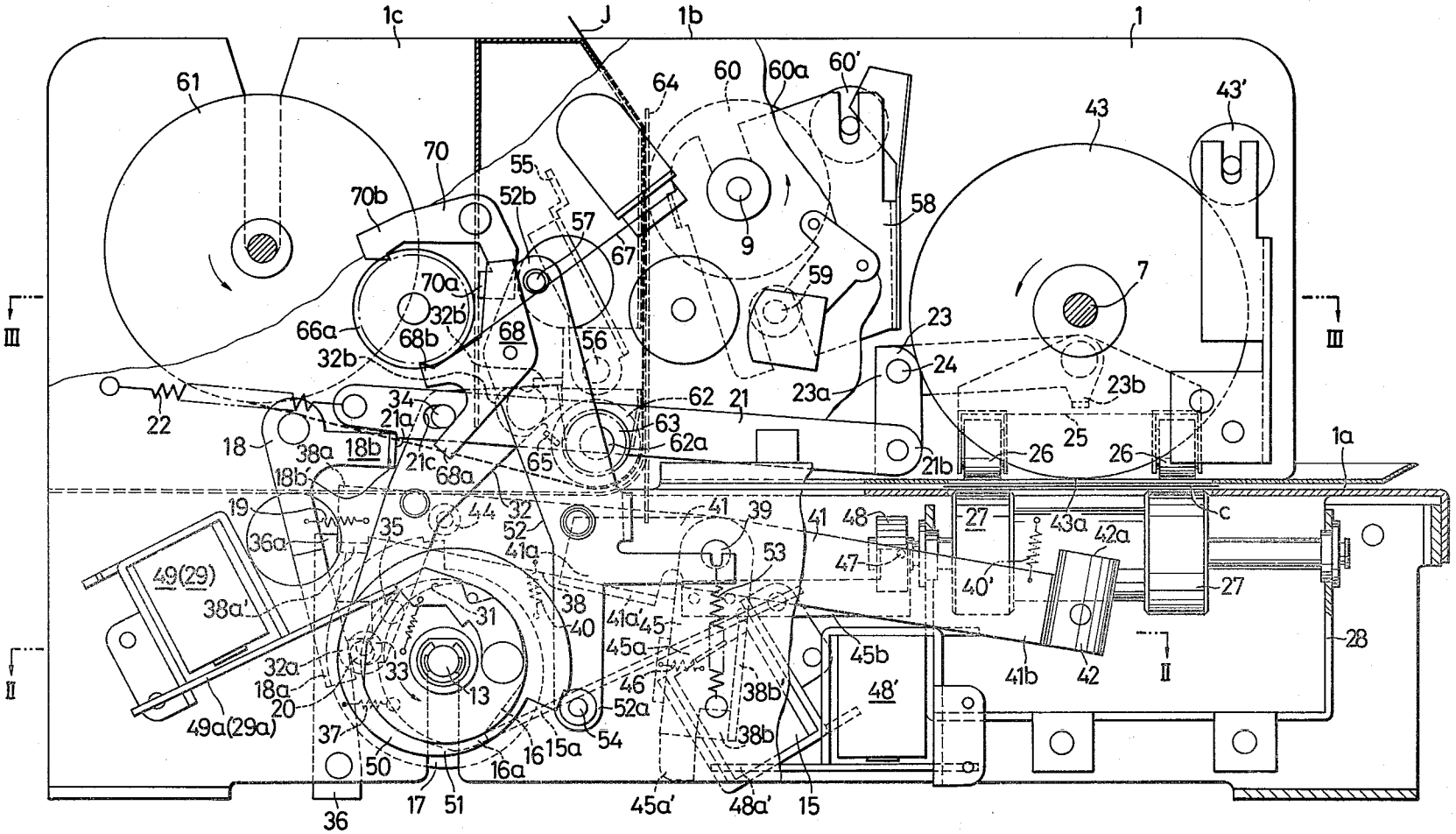
FIG. 1 is a partly sectioned elevational view of an embodiment of the printing device according to the present invention.
Figure 3:
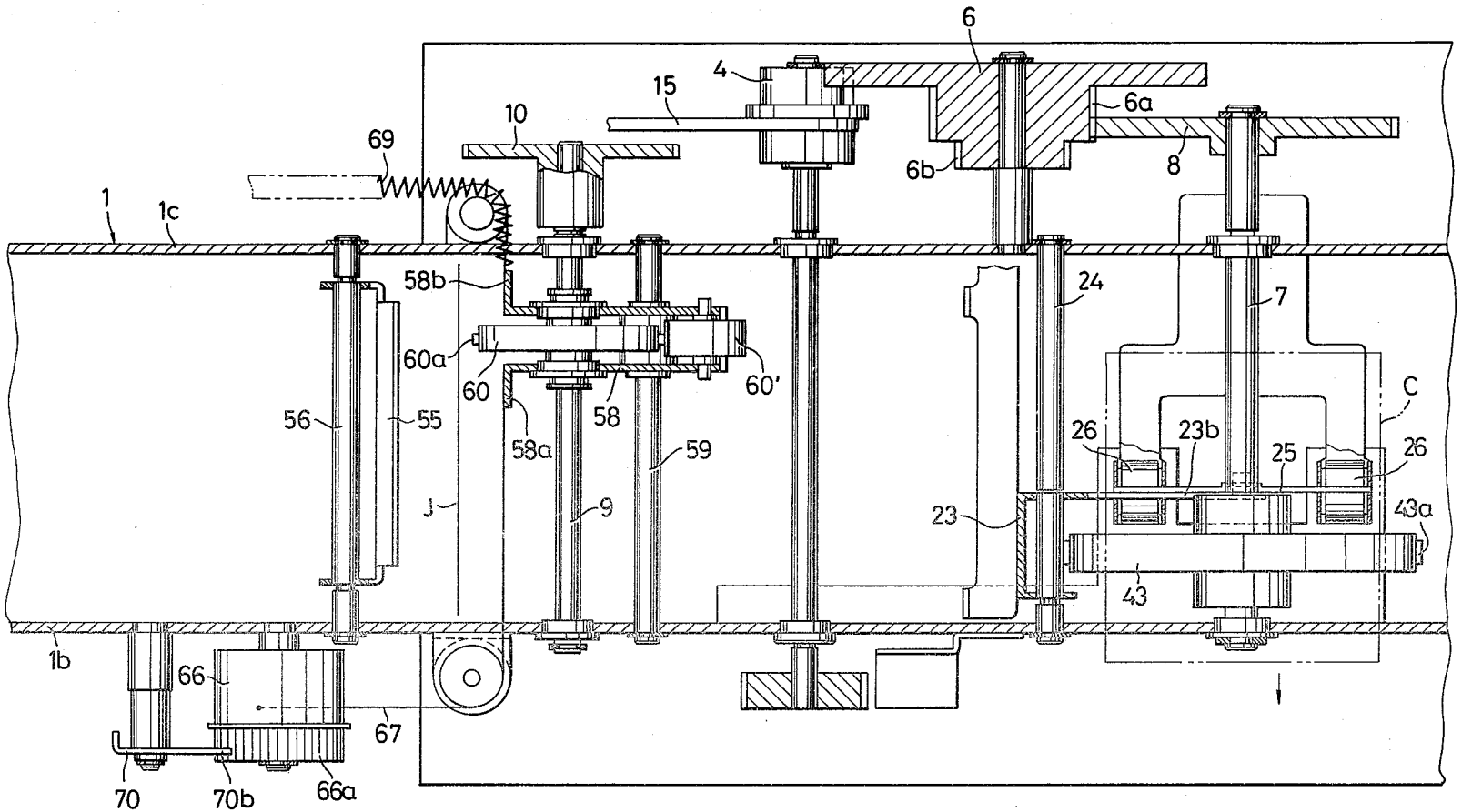
FIG. 3 is a sectional view developed substantially along line III—III in FIG. 1.
Figure 4:
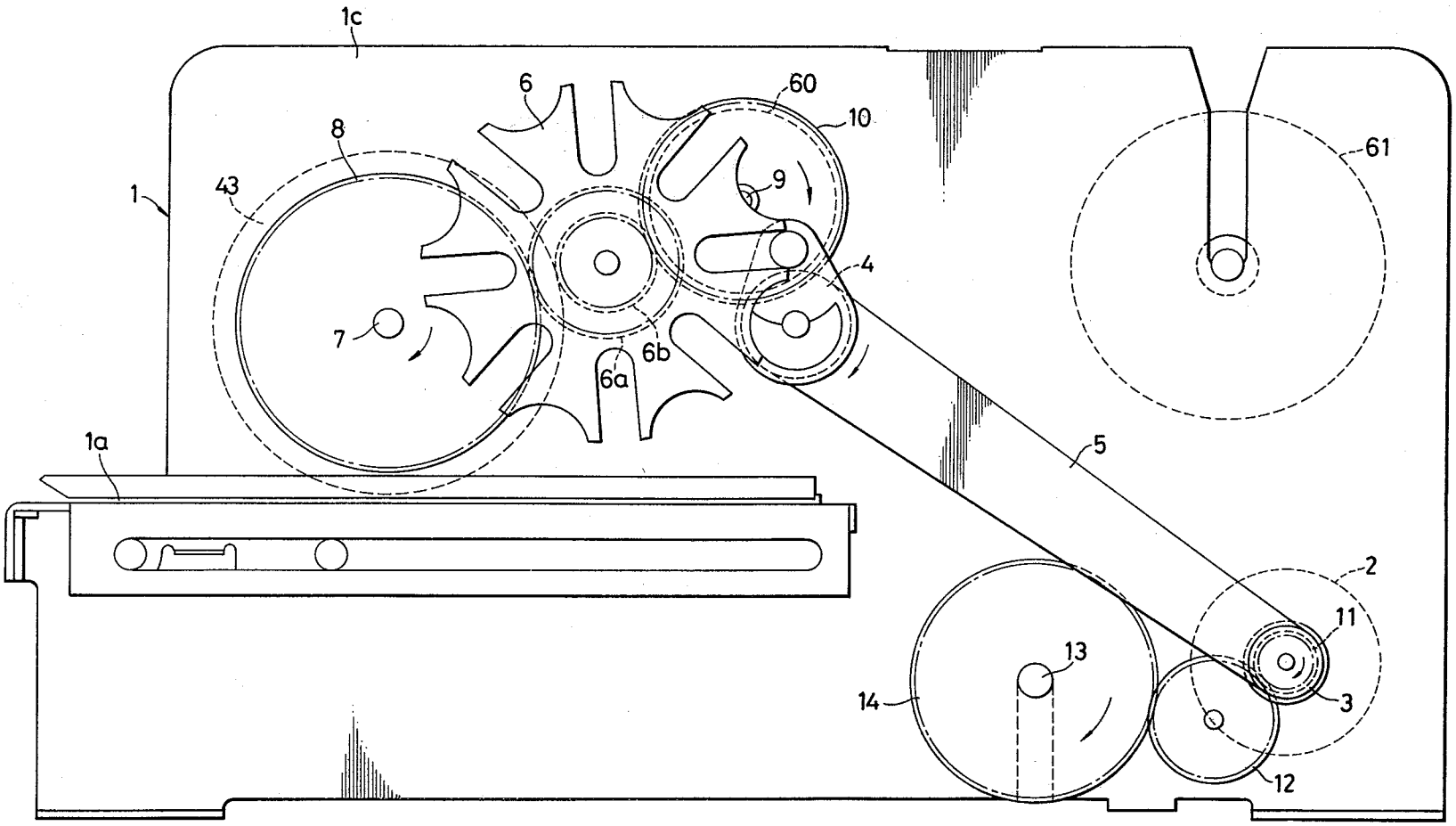
FIG. 4 is a rear view of FIG. 1.

With reference to the drawings, reference numeral 1 indicates a frame which is provided with a horizontal check inserting part 1*a* opened in the right direction and the direction at right angles with it and a pair of parallel supporting plates 1*b* and 1*c* serving also as guides for a journal paper. 2 indicates a driving motor which is secured on the frame 1 and is operated by a driving signal from a printing instructing means not illustrated. 3 indicates a pulley which is directly connected to the driving motor 2 and is rotated clockwise in FIG. 4. 4 indicates a Geneva driver which is rotated by the pulley 3 through a belt 5. 6 indicates a Geneva gear which is intermittently rotated by the Geneva driver 4. 7 indicates a check printing wheel shaft which is laterally mounted between the supporting plates 1*b* and 1*c* and is intermittently rotated counterclockwise in FIG. 1 by a large diameter gear 6*a* integral with the Geneva gear 6 through a gear 8 secured to one end of it. 9 indicates a journal printing wheel shaft which is rotatably laterally mounted between the supporting plates 1*b* and 1*c* and is intermittently rotated counterclockwise in FIG. 1 by a small diameter gear 6*b* integral with the Geneva gear 6 through a gear 10 secured to one end of it (The small diameter gear 6*b* and gear 10 are not in mesh with each other in FIG. 3 for the convenience of the drawing but are in fact in mesh with each other as shown in FIG. 4). A printing wheel driving means is formed of the above mentioned respective elements. The numbers of teeth of the respective gears 6*a*, 8, 6*b* and 10 are so selected that the check printing wheel shaft 7 and journal printing wheel shaft 9 may rotate synchronously with each other.

Reference numeral 11 indicates a driving gear integral with the pulley 3. 12 indicates an idle gear rotated by the driving gear 11. 13 indicates a clutch shaft which is rotatably laterally mounted between the supporting plates 1*b* and 1*c* and is rotated counterclockwise in FIG. 1 by the idle gear 12 through a gear 14 secured to one end of it. A clutch shaft driving means is formed of the above elements. In this clutch shaft driving means, the rotation ratios of the respective elements are so selected that the clutch shaft 13 may make one rotation with four intermittent rotating operations of the Geneva gear 6.

Reference numeral 15 indicates a check printing magnet which is secured to the supporting plate 1*c* and is energized by a pulse signal from the printing instructing means not illustrated. 16 indicates a check cam clutch which is mounted on the clutch shaft 13 adjacently to the check printing magnet 15 and is normally locked by the engagement of the tip of an armature lever 15*a* of the check printing magnet 15 with a ratchet pawl 16*a* but will be unlocked to rotate together with the clutch shaft 13 when the magnet 15 is energized. 17 indicates a check cam which is secured to the clutch 16 and is rotatably mounted on the clutch shaft 13. 18 indicates a paper pressing release lever which is pivoted on the supporting plate 1*b*, is biased counterclockwise in FIG. 1 by a spring 19 and is rotated clockwise by being pushed at one end 18*a* against the tension of the spring 19 by the paper processing release pin 20 planted on the check cam 17 by the rotation of the check cam 17. 21 indicates a paper pressing driving lever which is arranged slidably in the horizontal direction in FIG. 1 on the supporting plate 1*b*, is biased leftward by a spring 22 and is normally locked by the engagement of the bent part 18*b*′ of the other end 18*b* of the release lever 18 with one end 21*a* of it but will be unlocked to slide leftward when the release lever 18 is rotated clockwise. 23 indicates an L-shaped paper pressing lever which is rotatably mounted on a supporting shaft 24 mounted between the supporting plates 1*b* and 1*c*, is connected at one end 23*a* to the other end 21*b* of the driving lever 21, will be rotated clockwise when the driving lever 21 is slid leftward in FIG. 1 and will be rotated counterclockwise when the driving lever 21 is slid rightward. 25 indicates a paper pressing lever which is pivoted substantially in the middle portion on the other end 23*b* of the paper pressing lever 23, has paper pressing rollers 26, 26 arranged in both end poritons, will lower to press the paper pressing rollers 26, 26 into contact with paper feeding rollers 27, 27 to thereby press a check C when the paper pressing lever 23 is rotated clockwise and will rise to separate the paper pressing rollers 26, 26 from the paper feeding rollers 27, 27 when the paper pressing lever 23 is rotated counterclockwise. The paper feeding roller 27 is rotatably supported so as to be positioned just below the paper pressing rollers 26, 26 by a supporting member 28 secured to the supporting plate 1*c*. A paper pressing means is formed of the above elements.

Reference numeral 29 indicates a journal paper feeding magnet which is secured to the supporting plate 1*b* and is energized by a pulse signal from the printing instructing means not illustrated. 30 indicates a journal paper feeding cam clutch which has the same structure as of the above mentioned check cam clutch 16, is mounted on the clutch shaft 13 adjacently to the magnet 29 and is normally locked by the armature lever 29*a* of the magnet 29 but will be unlocked to rotate together with the clutch shaft 13 by the displacement of the armature lever 29*a* when the magnet 29 is energized. 31 indicates a journal paper feeding cam which is secured to the clutch 30 and is rotatably mounted on the clutch shaft 13. 32 indicates a journal paper feeding lever which is pivoted to the supporting plate 1*b*, has a pin 33 engaged with the cam 31 and planted at one end 32*a* and has a paper pressing returning pin 34 fitted in a slot 21*c* of the pressing driving lever 21 and planted at the other end 32*b* so that, when it is rotated clockwise in FIG. 1 by the rotation of the cam 31, the driving lever 21 may be slid rightward against the tension of the spring 22 to thereby release the pressing contact of the paper pressing rollers 26, 26 with the paper feeding rollers 27, 27. A paper pressing releasing means is formed of the above elements. When the paper pressing driving lever 21 is slid rightward, it will be again locked by the release lever 18.

Figure 2:
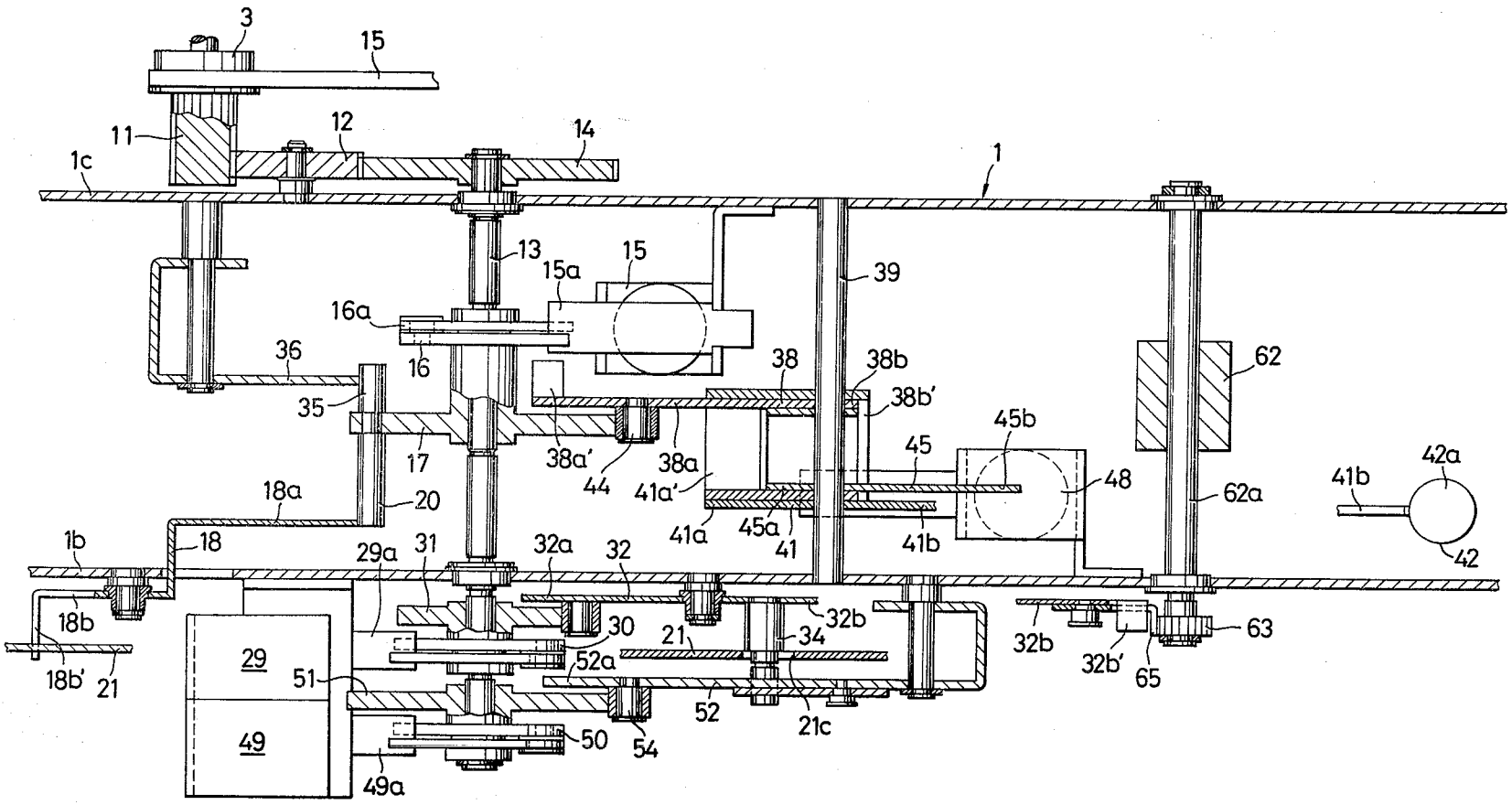
FIG. 2 is a sectional view developed substantially along line II—II in FIG. 1.

Reference numeral 35 indicates a check hammer releasing pin planted on the check cam 17. 36 indicates a check hammer releasing lever which is pivoted on the supporting plate 1*c*, is biased clockwise in FIG. 1 by a spring 37 and will be rotated counterclockwise when pushed against the tension of the spring 37 by the pin 35 with the rotation of the check cam 17. 38 indicates a check cam lever which is rotatably mounted on a supporting shaft 39 laterally mounted between the supporting plates 1*b* and 1*c*, is biased counterclockwise in FIG. 1 by a spring 40 and is normally locked by the engagement of one end 36*a* of the lever 36 with a bent part 38*a*′ of one end 38*a* of it but will be unlocked to rotate counterclockwise when the lever 36 is rotated counterclockwise (The lever 36 and lever 38 are not engaged with each other in FIG. 2 for the convenience of the drawing but are in fact engaged with each other as shown in FIG. 1). 41 indicates a check hammer lever which is rotatably mounted on the supporting shaft 39 and has a bent part 41*a*′ at one end in contact with the side wall of the lever 38 so as to be rotated counterclockwise and clockwise in FIG. 1 while following the movement of the lever 38. 42 indicates a check hammer which is pivoted rockably within some range on the other end 41*b* of the lever 41, has on the upper surface a striking surface 42*a* having notches for notched numerals formed and will print the digits on the check C by striking the type surface of a later described check printing wheel when the lever 41 is rotated counterclockwise in FIG. 1. 43 indicates the check printing wheel which has notches formed on its peripheral surface or the type surface 43*a* so as to coincide with the notches on the striking surface 42*a* of the hammer and is secured to the shaft 7 so as to be intermittently rotated together with the shaft 7 so that, when it rotates, the type coming to the printing position may be detected by a detecting means not illustrated connected with the printing means. 43′ indicates an ink roller for feeding ink to the printing wheel 43. These elements together with the above described magnet 15, clutch 16 and cam 17 form a check printing means. By the way, as the hammer 42 is made rockable with respect to the lever 42 as described above, even if the projection of the striking surface 42*a* and the projection of the type surface 43 collide with each other at the time of striking, the projection of the striking surface 42*a* will be able to slide to fit with the recess of the type surface. 44 indicates a cam lever pin which is planted on the lever 38 at the end 38*a* side of said lever 38 and can engage with the cam 17 so that, when it is pushed up with the rotation of the cam 17, the lever 38 may be returned against the tension of the spring 40, that is, may be rotated clockwise in FIG. 1. These elements together with the above described cam 17 forms a check printing returning means. When the lever 38 is returned to the original position (illustrated), it will be again locked by the lever 36.

Reference numeral 45 indicates a check figure feeding lever which is rotatably mounted on the supporting shaft 39, is connected at one end 45*a* to the other end 38*b* of the lever 38 through a spring 46 and has the bend part 38*b*′ of the other end 38*b* of the lever 38 engaged from the right in FIG. 1 with the side of said end 45*a* so as to be rotated counterclockwise and clockwise while following the movement of the lever 38, 47 indicates a ratchet pawl provided at the other end of the lever 45. 48 indicates a check figure feeding ratchet gear which is connected together with the roller 27 and is engaged with the ratchet pawl 47 so as to be rotated clockwise as seen from the left in FIG. 1 by the ratchet pawl 47 and intermittently move, that is, figure-feed the check C downward in FIG. 3 with the roller 27 when the lever 45 is rotated clockwise in FIG. 1. These elements together with the above described magnet 15, clutch 16, cam 17, pin 35, levers 36 and 38, pin 44 and roller 27 form a one-pitch figure feeding means for the check C. 48′ indicates a magnet which is secured to the supporting plate 1*b* and is energized by a pulse signal from the printing instructing means not illustrated. When this magnet 48′ is energized, an armature lever 48*a*′ of the magnet will enter the track of one end 45*a* of the lever 45 and will collide with its tip 45*a*′ to stop the counterclockwise rotation of the lever 45 on the way so that the figure feeding of the check C may be half the normal pitch. A half-pitch figure feeding means for the check C is formed by thus adding the magnet 48*a*′ and lever 48*a*′ to the pitch figure feeding means.

Reference numeral 49 indicates a journal printing magnet which is provided in parallel with the journal paper feeding magnet 29 and is energized by a pulse signal from the printing instructing means not illustrated. 50 indicates a journal cam clutch which has the same structure as of the journal paper feeding clutch 30, is mounted on the clutch shaft 13 adjacently to the magnet 49 and is normally locked by the armature lever 49*a* of the magnet 49 but will be released by the displacement of the armature lever 49*a* to rotate together with the clutch shaft 13 when the magnet 49 is energized. 51 indicates a journal cam secured to the clutch 50 and mounted on the clutch shaft 13. 52 indicates a journal hammer driving lever which is pivoted to the supporting plate 1*b*, is biased clockwise in FIG. 1 by a spring 53, has a pin 54 which is planted at one end 52*a* engaged with the cam 51 so as to be momentarily clockwise rotated by the tension of the spring 53 with the rotation of the cam 51 and then gradually returned to the original position against the tension of the spring 53. 55 indicates a journal hammer which is rotatably mounted on a supporting shaft 56 laterally mounted between the supporting plates 1*b* and 1*c* and is engaged with a journal hammer driving pin 57 planted at the other end of the lever 52 so as to be momentarily clockwise rotated to strike the type surface of a later described journal printing wheel to print on the journal J when the lever 52 is momentarily rotated clockwise in FIG. 1. 58 indicates a journal printing wheel holder which is movably mounted on both of the shaft 9 and a supporting shaft 59 laterally mounted between the supporting plates 1*b* and 1*c* parallelly with the shaft 9. 60 indicates the aforesaid journal printing wheel which has a type surface 60*a* formed on the peripheral surface, is positioned within the holder 58 and is mounted on the shaft 9 so as to be movable in the axial direction but to be forcibly intermittently rotated counterclockwise in FIG. 1 with the rotation of the shaft 9 so that, when it rotates, the type to come to the printing position may be detected by a detecting means not illustrated connected to the printing instructing means. 60' indicates an ink roller for feeding ink to the journal printing wheel 60. A journal printing means is formed of the above mentioned elements.

Now, reference numeral 61 indicates a journal paper roll which is rotatably mounted between the supporting plates 1*b* and 1*c*. 62 indicates a paper feeding rubber roller which is rotatably mounted between the supporting plates 1*b* and 1*c* and is fitted to a rotary shaft 62*a* having a gear 63 secured to the outer end. 64 indicates a journal guide which is arranged between the supporting plates 1*b* and 1*c* and guides the journal J from the journal paper roll 61 out of the device through the paper feeding rubber roller 62 and printing wheel 60. 65 indicates a paper feeding pawl which is pivoted to the other end 32*b* of the lever 32 and is limited in the upward rocking by the bend part 32*b'* of said other end 32*b* so as to mesh with the gear 63 to rotate the roller 62 counterclockeise and intermittently feed the journal J when the journal paper feeding lever 32 is rotated clockwise in FIG. 1. These elements together with the above described magnet 29, clutch 30, cam 31 and lever 32 form a journal paper feeding means.

Reference numeral 66 indicates a figure feeding pulley pivoted to the supporting plate 1*b*. 67 indicates a wire stretched between the pulley 66 and one end 58*a* of the holder 58. 68 indicates a journal figure feeding pawl which is pivoted on the other end 52*b* of the lever 52, is engaged at one end 68*a* with the pin 34 and has a pawl part 68*b* engageable with a gear part 66*a* of the pulley 66 so that, when the lever 52 rotates counterclockwise in FIG. 1, the holder 58 may be intermittently moved downward in FIG. 3, that is, the journal printing wheel 60 may be figure-fed by winding up the wire 67 by rotating the pulley 66 clockwise in FIG. 1. These elements together with the above described magnet 49, clutch 50, cam 51 and lever 52 form a journal figure feeding means.

Reference numeral 69 indicates a return spring which is connected to the other end 58*b* of the holder 58 and biases the holder 58 to return or move upward in FIG. 3. 70 indicates a figure feeding stopper pawl which is rockably pivoted on the supporting plate 1*b*, has the bent part 70*a* engaged with the other end side of the feeding pawl 68 from the left in FIG. 1 and has the pawl part 70*b* meshable with the gear part 66*a* of the pulley 66 so that, when the figure is fed, the pulley 66 may be prevented from returning, that is, rotating counterclockwise but, when the lever 32 is rotated clockwise in FIG. 1 and thereby the feeding pawl 68 is rotated counterclockwise, the stopper pawl 70 may be rotated clockwise to allow the pulley 66 to rotate counterclockwise and return the printing wheel 60 to the position of the first figure. These elements together with the magnet 29, clutch 30, cam 31, lever 32 and pawl 68 form a journal figure returning means.

Figure 5:
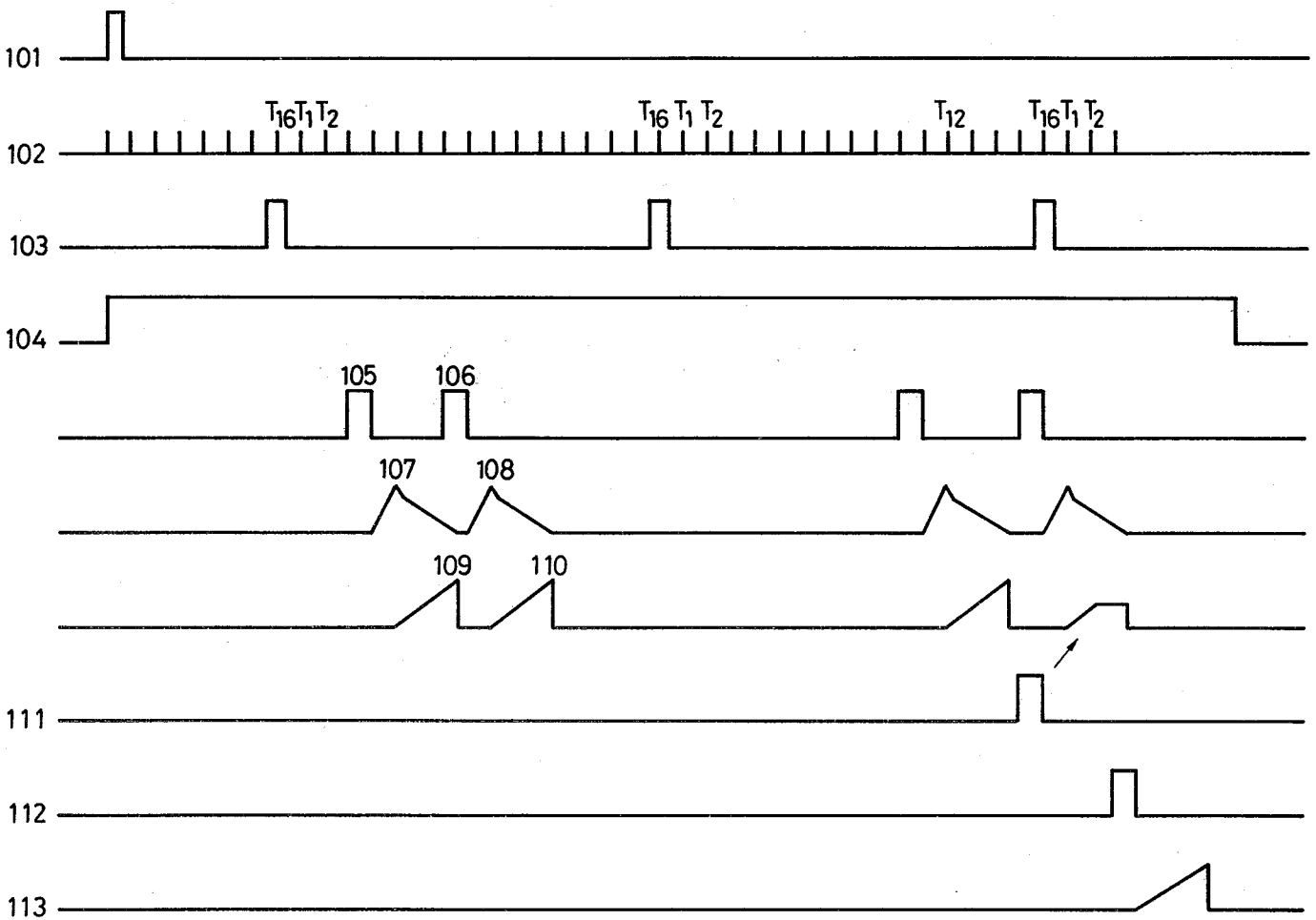
FIG. 5 is a time chart showing the relations between periods of generating various instructing pulses to be put into the printing device from the printing instructing means and periods of operating various operating means.

FIG. 5 is a time chart showing periods of generating respective pulse signals from the printing instructing means and periods of operating the above mentioned respective operating means. Reference numeral 101 indicates a printing instructing pulse, 102 indicates a timing pulse, 103 indicates a reset pulse, 104 indicates a motor driving signal, 105 indicates a check printing magnet energizing pulse, 106 indicates a journal printing magnet energizing pulse, 107 indicates a check printing time, 108 indicates a journal printing time, 109 indicates a check feeding time, 110 indicates a journal printing wheel feeding time, 111 indicates a half-pitch feeding magnet energizing pulse, 112 indicates a journal paper feeding magnet energizing pulse and 113 indicates a journal paper feeding time and journal printing wheel returning time. The above mentioned respective pulses are made to be generated at proper time intervals so that the respective means of the present device may operate smoothly and accurately in a proper order.

The operation of the present device is as follows. For example, the case of printing digits "237564" will be described. First of all, as shown in FIG. 1, the check C is inserted into the check inserting part 1*a*. On the other hand, the journal J is passed into the journal guide 64. Then, if the keys of "2," "3," "7," "5," "6" and "4" of the keyboard of the printing instructing means not illustrated are pushed in turn, "237564" will be indicated in the indicating tube of the printing instructing means and, at the same time, "237564" will be memorized in the memorizing means within the printing instructing means. Then, if a function key of the printing instructing means is pushed, the printing instructing pulse 101 will be issued, the motor driving signal 104 will be issued with it and the driving motor 2 of the present device will begin to rotate. When the driving motor 2 rotates, the printing wheels 43 and 60 will be intermittently rotated in synchronization with each other through the pulley 3, belt 5, Geneva driver 4, Geneva gear 6 and gears 6*a*, 6*b*, 8 and 10 and the clutch shaft 13 will begin to continuously rotate. Further, during the rotation of the printing wheels 43 and 60, the type coming to each printing position will be detected by the detecting means. It is needless to say that, in this case, the types on the respective printing wheels coming to the respective printing positions at the same time are adjusted in advance so as to be always identical. Thus, when the type of "2" comes to each printing position, the detecting device will detect it and the pulses 105 and 106 will be issued from the printing instructing means. As a result, the magnet 15 will be energized and the locking piece 15*a* will be unlocked from the ratchet pawl 16*a*. Therefore, the clutch 16 will be rotated by one rotation counterclockwise in FIG. 1 together with the already rotating clutch shaft 13. By this rotation of the clutch 16, the check cam 17 will be also rotated counterclockwise and, at the same time, by the pin 20, the release lever 18 will be rotated clockwise in FIG. 1 to unlock the driving lever 21. Therefore, by the spring 22, the driving lever 21 will be slid leftward in FIG. 1. As a result, the paper pressng lever 23 will be rotated clockwise in FIG. 1 around the supporting shaft 24. By this clockwise rotation of the lever 23, the lever 25 will be lowered while keeping the posture shown in FIG. 1 to press the pair of rollers 26, 26 against the opposed pair of rollers 27, 27. A little later than this operation, the lever 36 will be pushed by the pin 35 planted on the cam 17 to be rotated counterclockwise in FIG. 1, therefore the lever 38 will be rotated counterclockwise in FIG. 1 by the spring 40 and, at the same time, the hammer 41 will be also rotated counterclockwise. Thus, "2" will be printed on the check C by the hammer 42. After this printing is made, the pin 44 will be pushed up on the lever 38 by the cam 17, therefore the lever 38 will be rotated clockwise in FIG. 1, at the same time, the hammer lever 41 will be also clockwise rotated and the hammer 42 will separate from the check C and will be returned to the position in FIG. 1. When the lever 38 rotates clockwise, the ratchet gear 48 will be rotated by one pitch by the ratchet pawl 47 provided on the lever 45. As a result, the rollers 27, 27 will be rotated and the check C will be fed by one figure. Substantially simulataneously with the energization of the magnet 15, the magnet 49 will be also energized, the armature lever 49*a* will be unlocked from the clutch 50. Therefore, the clutch 50 will be rotated counterclockwise in FIG. 1 together with the clutch shaft 13 and the cam 51 will be also rotated counterclockwise together with it. By this counterclockwise rotation of the cam 51, the driving lever 52 will be quickly rotated clockwise to rotate the hammer 55 clockwise toward the printing wheel 60 to print "2" on the journal J. While the printing is thus made on the journal J and the hammer 55 is returned to the position in FIG. 1 following the returning motion of the driving lever 52, by the cooperating action of the feeding pawl 68 and the gear part 66*a* of the pulley 66, the printing wheel 60 will be fed by one figure through the wire 67. Then, "3" must be printed. However, while the cam 17 for driving the hammer 42 and the cam 51 for driving the hammer 55 make respectively one rotation, as obvious from the time chart in FIG. 5, the respective types of "6" will have come to the printing positions on the respective printing wheels 43 and 60 and therefore "3" will not be able to be printed just after the above mentioned "2" printing operation. Therefore, when the type of "3" comes to each printing position in the second rotation of each of the printing wheels 43 and 60, "3" will be printed on each of the check C and journal J in the same operating order as is mentioned above. Next, "7" is to be printed. In this case, when the check cam 17 and journal cam 51 make one rotation, the type of "7" of each of the printing wheels 43 and 60 will come to each printing position and therefore "7" will be able to be continuously printed as it is on each of the check C and journal J. Thus, in the same manner, the types of "5," "6" and "4" will be printed in turn on the check C and journal J respectively in the third, fourth and fifth rotations of each printing wheel. When the printing of all the figures is thus completed, the energizing pulse 112 for the journal paper feeding magnet 29 will be issued from the printing instructing means. That is to say, when the pulse 112 is issued, the magnet 29 will be energized and the armature lever 29*a* will be displaced to release the clutch 30. Therefore, the clutch 30 will be rotated counterclockwise in FIG. 1 together with the shaft 13 to rotate the cam 31 counterclockwise. When the cam 31 is thus rotated counterclockwise, the lever 32 will be pushed up by the cam surface of the cam 31 so as to be rotated clockwise. By this clockwise rotation of the lever 32, the lever 21 will be slid rightward in FIG. 1 against the spring 22 and will be again locked by the release lever 18. By this rightward movement of the lever 21, the rollers 26, 26 will separate from the rollers 27, 27, the check C will be released from the pressed contact with the rollers 27, 27 so as to be able to be freely pulled out of the inserting part 1*a*. On the other hand, simultaneously with the above mentioned clockwise rotation of the lever 32, the pulley 66 will be released through the feeding pawl 68 and stopper pawl 70, the printing wheel 60 will be returned to the printing position of the first figure by the return spring 69 and the roller 62 will be rotated counterclockwise through the paper feeding pawl 65 to advance the journal J by a predetermined length.

When, as described above, a series of printing on the check C and journal J is completed, the pressed contact of the check C is released and the journal J is advanced by a predetermined length, the motor driving signal 104 from the printing instructing means will vanish, therefore the motor 2 will stop rotating and the operation of the entire device will end.

During the above mentioned operation, in case a comma or the like is to be printed, the pulse 111 will be sent to the half-pitch feeding magnet 48' from the printing instructing means. When the magnet 48' is energized by the pulse 111, the lever 48*a'* will advance into the track of one end 45*a* of the lever 45 and the lever 45 will be regulated to rock by only half the normal rocking angle. As a result, the check C will be figure fed by only half a pitch.

In the above explanation, the driving force source of the check hammer lever 41 is given by the spring 40 acting on the check cam lever 38. However, this driving force source may be given by connecting the spring 40' directly to the lever 41 as shown by the chain line in FIG. 1. It is needless to say that this modification can be applied also to the journal hammer 55. That is to say, the spring 53 may be connected to the journal hammer 55 instead of being connected to the journal hammer driving lever 52.

We claim:

1. A printing device comprising a frame having a pair of parallelly arranged side plates; a first and second printing means arranged between said pair of side plates; a first feeding means which is arranged in association with said first printing means and is to intermittently feed in one direction such sheet to be printed as a check placed in a printing position; a figure feeding means which is arranged in association with said second printing means and is for a journal inserted in a printing position; a returning means capable of returning to the initial position a journal printing wheel which is included in said second printing means; a second feeding means which is arranged in association with said second printing means and can feed said journal by a predetermined length in one direction at the time of the operation; a driving shaft rotatably supported by said side plates; and a plurality of clutch means which are mounted on said driving shaft and can operate said first printing means, second printing means, first feeding means, second feeding means, figure feeding means and returning means; the printing and feeding operations for said sheet to be printed, printing and figure-feeding operations for said journal, returning operation of said journal printing wheel and feeding operation for said journal being made independently in a predetermined order by said plurality of clutch means.

2. A printing device according to claim 1 wherein said printing device further comprises a first cam member rotatably mounted on said driving shaft in response to any one of said plurality of clutch means; and said first printing means includes a first hammer member rotatably supported by said frame, a first driving lever which is rotatably supported by said frame and is engaged at one end with said first hammer member and at the other end with said first cam member, and a first spring which is connected to either one of said first driving lever and first hammer member and biases either one of said first hammer member and first driving member to move said first hammer member to the printing position; said first hammer member being moved to print digits by said first driving lever and then being returned to the original position while said first cam member is made to make one rotation integrally with said driving shaft by the operation of said clutch means; and said first feeding means being operated by either one of said first driving lever and first hammer member while said first hammer member is turned to the initial position.

3. A printing device according to claim 2 wherein said first feeding means comprises a figure feeding lever which is pivoted to said frame and has a first ratchet pawl at the tip, a second spring which is connected between said first driving lever and figure feeding lever, a first ratchet gear rotatably supported on said frame, feeding rollers which are connected to said ratchet gear and can contact said sheet to be printed, and an electromagnetic means which is secured on said frame and has a half-pitch feeding lever engageable with said figure feeding lever; said figure feeding lever being locked by said half-pitch feeding lever in the course of its rotation at the time of the operation of said first driving lever thereby to regulate said feeding rollers so as to be rotated by half a pitch when said half-pitch feeding lever is brought to a position engageable with said figure feeding lever by the energization of said electromagnetic means.

4. A printing device according to claim 1 wherein said printing device further comprises a second cam member rotatably mounted on said driving shaft in response to any one of said plurality of clutch means; said second printing means includes a second hammer member rotatably supported by said frame, a second driving lever which is rotatably supported by said frame and is engaged at one end with said second hammer member and at the other end with said second cam member, and a third spring which is connected to either one of said second driving member and second hammer member and biases either one of said second driving lever and second hammer member to move said second hammer to the printing position; said figure feeding device comprises a winding drum which is rotatably supported by said frame and has a second ratchet gear, a second ratchet pawl which is pivoted on said second driving lever and is engageable with said second ratchet gear, and a wire connected between said winding drum and journal printing wheel; said second hammer member being moved to print by said second driving lever and then being returned to the initial position while said second cam member is made to make one rotation integrally with said driving shaft; and said journal printing wheel being fed by one figure in the figure direction through said second ratchet pawl, second ratchet gear and wire while said second hammer member is returned to the initial position.

5. A printing device according to claim 1 wherein said first feeding means comprises a pair of feeding rollers which are placed in the printing position and can contact said sheet, and a pair of pressing rollers arranged as opposed respectively to said pair of feeding rollers; said pair of pressng rollers being so arranged as to be moved to hold said sheet in cooperation with said pair of feeding rollers just before said first printing device begins to operate.

6. A printing device according to claim 1 wherein said printing device further comprises a third cam member which is rotatably mounted on said driving shaft in response to any one of said plurality of clutch means, a journal paper feeding lever which is rotatably supported on said frame and is engageable at one end with said third cam member, and a third driving lever which is pin-slot-connected to the other end of said journal paper feeding lever and is operatively connected to said returning means; said returning means and second feeding means being simultaneously operated through said journal paper feeding lever and third driving lever when said third cam member is rotated integrally with said driving shaft by the operation of said clutch means.

7. A printing device according to claim 1 wherein said frame has an inserting port opened on three adjacent sides to place said sheet in the printing position, and said pair of side plates are arranged as separated from each other by a distance substantially equal to the width of said journal to guide said journal.

8. A printing device according to claim 1 wherein said first printing means includes a check printing wheel which is rotatably supported by said pair of side plates, and said check printing wheel and journal printing wheel are connected with each other to synchronously rotate.

9. A printing device according to claim 1 wherein said first printing means includes a check printing wheel which is rotatably supported by said pair of side plates, a first hammer member which is rotatably supported by said frame and can be made to collide with said check printing wheel to print digits, and a first driving means for driving said first hammer member; said second printing means includes a second hammer member which is rotatably supported by said frame and can be made to collide with said journal printing wheel to print digits, and a second driving means for driving said second hammer member; said printing device further comprises an intermittently driving means which is rotatably supported by said frame and is to intermittently rotate said check printing wheel and journal printing wheel in synchronization with each other; and said first and second hammer driving means are so arranged as to be operated respectively once by N operations of said intermittently driving means.

* * * * *